US005184609A

United States Patent [19]

Hart

[11] Patent Number: 5,184,609

[45] Date of Patent: Feb. 9, 1993

[54] DIVERS FIRST STAGE ADJUSTABLE REGULATOR

[75] Inventor: Dennis L. Hart, Newport Beach, Calif.

[73] Assignee: U.S. Divers Co., Inc., Santa Ana, Calif.

[21] Appl. No.: 753,836

[22] Filed: Sep. 3, 1991

[51] Int. Cl.[5] ..... A62B 9/02

[52] U.S. Cl. ..... 128/205.24; 128/204.29; 128/204.26; 137/81.2; 137/172

[58] Field of Search ..... 128/205.24, 204.29, 128/204.26; 137/81.2, 172, 908, 859, 403; 73/861.47, 861.46, 861.45

[56] References Cited

U.S. PATENT DOCUMENTS

| | | | |
|---|---|---|---|
| 4,219,017 | 8/1980 | Shamlian | 128/204.26 |
| 4,226,257 | 10/1980 | Trinkwalder | 137/81.2 |
| 4,230,140 | 10/1980 | Hart | 137/81.2 |
| 4,354,520 | 10/1982 | Easley | 137/543.23 |
| 4,396,032 | 8/1983 | Duchesne | 137/81.2 |
| 4,527,582 | 7/1985 | Buckle | 137/81.2 |
| 4,882,459 | 11/1989 | Edwards, Jr. | 200/83 J |
| 4,900,883 | 2/1990 | Brame | 200/83 S |
| 5,097,860 | 3/1992 | Ferguson | 137/78.1 |

*Primary Examiner*—Edgar S. Burr
*Assistant Examiner*—Eric P. Raciti
*Attorney, Agent, or Firm*—George F. Bethel; Patience K. Bethel

[57] ABSTRACT

An adjustable regulator of the type having fluid coupling oil within a cavity exposed to ambient pressure and overlying a diaphragm which operates based upon imbalances of said ambient pressure and an intermediate pressure zone on the other side of said diaphragm. The adjustment of the spring on the diaphragm is accomplished by means of a cap screw which is screwed into the sidewalls of the regulator within the cavity holding the oil. The oil is prevented from draining from the cavity by a second diaphragm overlying the oil in the cavity which can flex based upon changes in ambient pressure. The cap screw has a threaded extension in the form of a stem and tool surface on the other side of said stem for turning said cap screw. The stem passes through the second diaphragm in a sealed manner to prevent flow of coupling fluid between the interface of the diaphragm and the stem while at the same time allowing for adjustment by turning the cap screw in its adjacent threads so that compression can be changed with regard to the spring thereby adjusting the entire regulator. A further improvement is a valve seat which deters delamination of the valving surface between the metal of the valve seat and the sealing material by the sealing medium extending into an intermediate pressure zone to help prevent delamination from the metal surface.

20 Claims, 3 Drawing Sheets

DIVERS FIRST STAGE ADJUSTABLE REGULATOR

FIELD OF THE INVENTION

The field of this invention lies within the art of regulating gas. More specifically it lies within the art of regulating breathing gas that is used by a person breathing from self-contained underwater breathing apparatus. Self-contained underwater breathing apparatus usually comprises a first stage or high pressure regulator and a second stage or demand regulator. The invention hereof relates to the high pressure or first stage regulator and valving of gas from the high pressure to an intermediate pressure for demand usage by a diver.

BACKGROUND OF THE INVENTION

The regulation of breathing gas by high pressure regulators is common to that required to regulate the flow of gas from a high pressure to an intermediate source. Such regulators are known in self-contained breathing apparatus such as for use by divers. Generally, the first stage or high pressure regulator regulates upwards of 3,500 psi gas to an intermediate or lower pressure. The regulation can be from the high pressure source of 3,500 psi down to approximately 120 to 140 psi.

After the first stage regulation of the high pressure gas, a demand or second stage regulator can be utilized for a diver using self-contained breathing apparatus. The demand regulator generally functions by inhalation creating movement of a diaphragm which in turn operates a valve that is linked to it. Upon the demand regulator valve opening, the first stage or high pressure regulator then regulates flow from the source, such as a high pressure tank.

This invention is concerned with regulation of the high pressure source to a second stage or demand regulator. Such regulators are known to have a diaphragm that is exposed to ambient pressure. The regulators are utilized with self-contained breathing apparatus used for industrial or firemen's safety equipment, as well as self-contained underwater breathing apparatus. Oftentimes, the high pressure regulator is attached to a valve of a tank by means of a yoke and a threaded securement. The high pressure source is allowed to flow into the regulator and after regulation, to the intermediate or demand regulator.

Such high pressure or first stage regulators generally have an operating diaphragm. The operating diaphragm is provided with a main spring for balancing against a spring pad and a spring support and spring adjustment screw. In effect, the diaphragm is maintained by the spring in a position to provide for opening and closing of the valve seat over a crown.

The area within the space occupied by the main spring, namely that between the spring support and adjustment screw and the spring pad is filled with a pressure coupling fluid such as a silicone oil. In some regulators in the past the diaphragm was directly exposed to ambient conditions. However, it has been found preferable to fill the space with silicone oil especially when the regulator is exposed to freezing conditions.

The spring support and adjustment screw is usually threaded into the side walls of the regulator and provided with a slot or keyway in order to threadably adjust it within the sidewalls to increase or decrease the compression on the spring.

Overlying the silicone oil and the spring support and adjustment as well as the spring is a covering or ambient sensing diaphragm. The diaphragm is maintained within the regulator body by means of a diaphragm retainer. The diaphragm overlays the adjustable spring support in the prior art. It had to be removed in order to adjust the spring support to vary the compression on the main spring.

When the diaphragm was removed by unthreading the diaphragm retainer, it became a complex operation due to the fact that silicone oil was utilized in the regulator. This caused innumerable problems in being able to adjust and maintain the compression of the main spring.

In order to overcome these adjustment problems, regulators were often times taken to a workshop or laboratory environment rather than adjusting them in the field. This being the case, a diver in the field could not easily adjust the regulators and found himself subject to adverse conditions.

This invention provides for adjustment of the regulator main spring without removal of the diaphragm. This avoids exposure of the liquid silicone to prevent spilling or for that matter contamination of the interior parts of the regulator.

In order to effectuate this, an adjustable spring support is provided with a stem and screw means extending through the covering diaphragm. The diaphragm is specifically oriented so as to allow for the stem of the adjustment screw for the regulator to pass therethrough and yet still seal the silicone oil behind the diaphragm.

The covering diaphragm is effectively seated into the regulator side walls and held therein by means of a diaphragm retainer. A screw means with a stem extends through the diaphragm and serves to provide the adjustment screw with proportional movement to allow it to move within the walls of the regulator. This attendantly avoids a disassembly of the regulator as is known in the prior art with the removal of the diaphragm and exposure of the interior of the regulator including the liquid silicone. Consequently, this invention is a substantial step over the prior art by allowing for improved regulator adjustment of a regulator having a diaphragm and fluid coupling oil.

SUMMARY OF THE INVENTION

This invention comprises a new adjustment means and diaphragm for the first stage of self-contained breathing apparatus. More specifically, it is a step over the prior art by virtue of its diaphragm and adjustment system in combination when placed in a first stage regulator.

The first stage regulator of this invention comprises a valved orifice and valve seat having an operative movable spring block. This provides a balance chamber in cooperation with a valve seat and crown around the orifice that is covered by the valve seat. The means for moving the valve seat from the crown is by means of a pin that transfers movement from a mushroom shaped pin support. The mushroom shaped pin support is such where it underlies a main diaphragm that interfaces with ambient pressure.

A main pressure regulating spring is located between the main diaphragm and ambient pressure. The main spring is seated against a spring pad and an adjustment screw support which receives liquid silicone there-around. The liquid silicone, and adjustment screw in part, are covered by a sealing diaphragm which senses external pressure and causes the silicone to couple and drive the main diaphragm.

The sealing and sensing diaphragm has a central opening through which a stem passes from the adjustment screw upwardly and expands into a screw head. The screw head can be provided with a keyway, screw slot, or other tool receiving means in order to turn the stem which is connected to the adjustment screw. This in turn causes a change in the main spring compression to attendantly change the operating pressure.

The entire system is sealed from ambient yet at the same time the adjustment screw for the main spring can be adjusted by means of a stem and screw member passing through the diaphragm exposed to ambient. Consequently, this invention is a step over the art by allowing facile and ready adjustment of a regulator without the attendant difficulty of disassembling and reassembling the regulator for adjustment purposes.

DETAILED DESCRIPTION OF THE PREFERRED EMBODIMENTS

Figure 1:
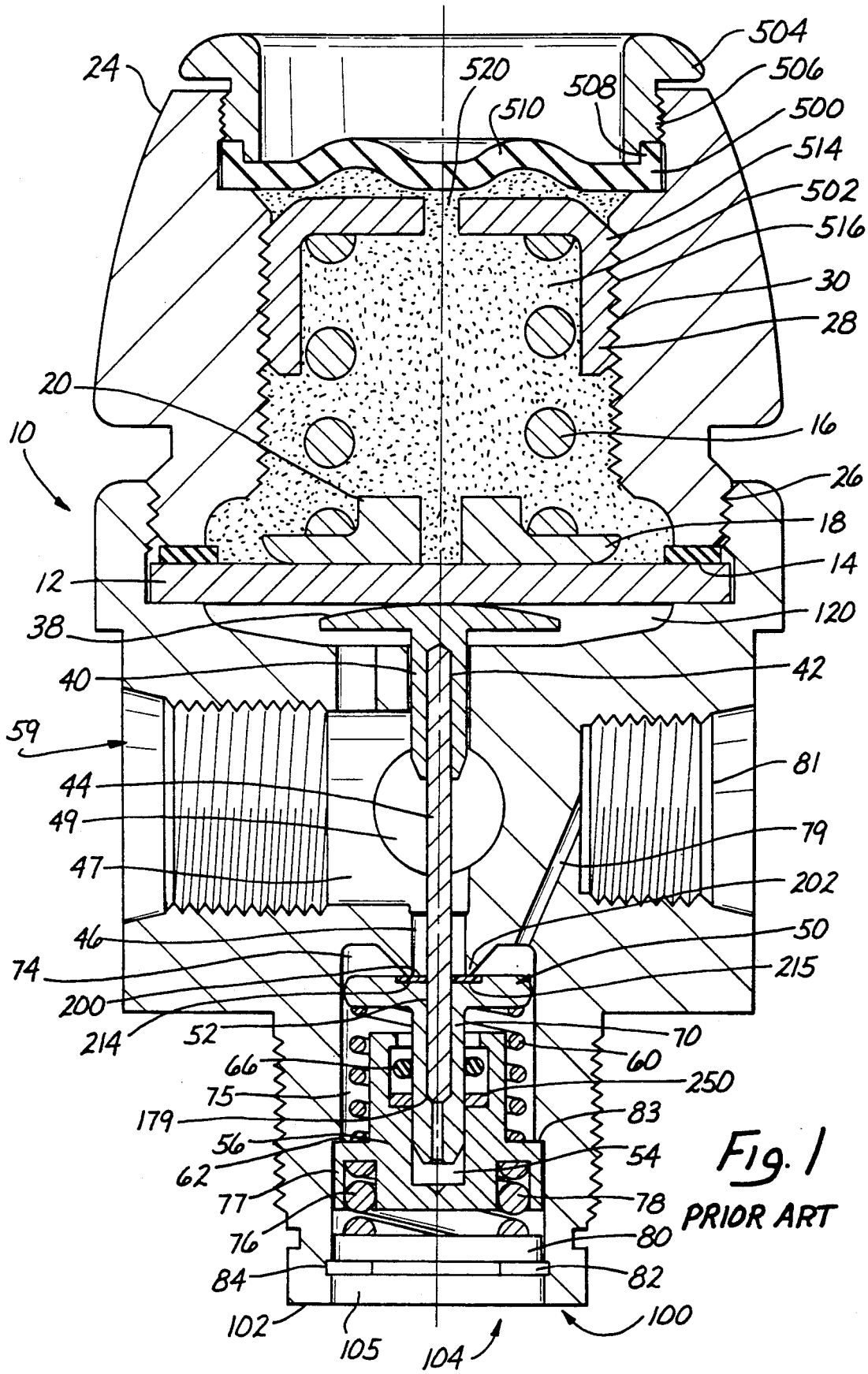
Fig. 1 PRIOR ART
FIG. 1 shows a midline sectional view of a typical prior art first stage regulator.

Looking more specifically at the figures in the entirety and in particular the prior art regulator of FIG. 1 which shall be described herein for background, it can be seen that there is a regulator body or valve body 10 that is shown. The regulator or valve body 10 can be made of various materials such as brass, stainless steel or other materials which are easily formed or machined.

The regulator of FIG. 1 has been shown bifurcated down its midline sectional view to illustrate the prior art. The instant invention pertains to the upper portion which shall be described after a general description of the portions of the regulator have been described which are common to the prior art and the invention.

Figure 2:
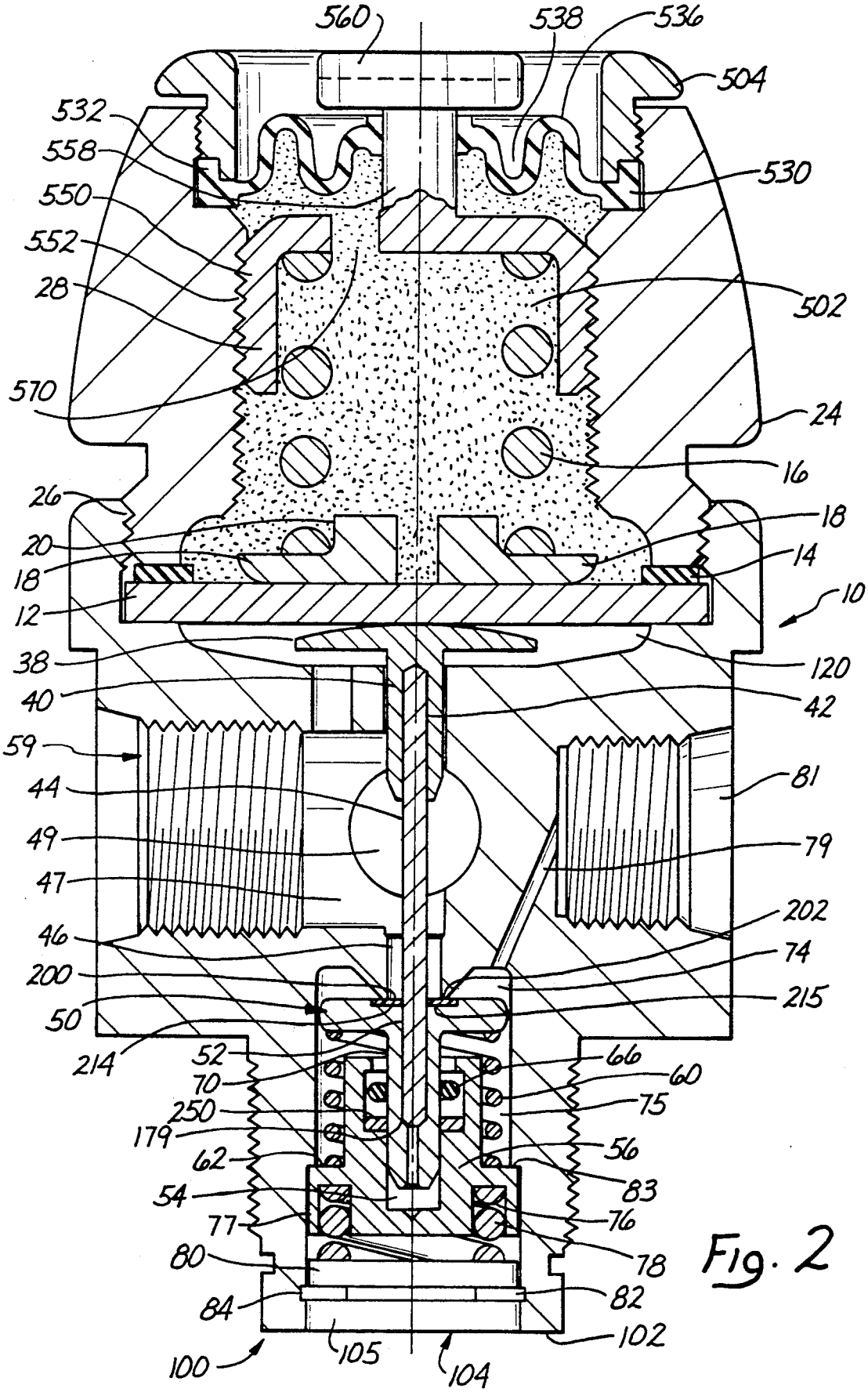
FIG. 2 shows a full midline sectional view of the regulator of this invention.

FIG. 2 and the remaining figures show the invention. The portions which are common to both the prior art and the invention are being described concurrently with respect to their common elements.

The regulator body 10 receives a membrane or diaphragm 12. The membrane or diaphragm 12 is made of an elastomeric rubber formed with two layers of rubber over fabric. It is the main operative diaphragm. The diaphragm 12 can be made of any other suitable material so long as it provides diaphragmatic flexibility in association with the other portions of the regulator.

A thrust washer 14 is utilized to prevent the membrane or diaphragm 12 from being damaged during assembly. The thrust washer 14 can be formed of any suitable material and configuration of any washer conformation to provide for protection of the diaphragm 12. A spring 16 is utilized to provide for regulation and control in the manner well known in the prior art. The spring 16 is seated against the diaphragm by means of a pad or spring support 18. The pad or spring support 18 receives the spring thereagainst by seating it around an upstanding portion 20.

In order to retain the spring 16 in seated relationship with the valve body 10, a spring retainer or cap 24 is utilized. The spring retainer or cap 24 is threaded into the valve body at threads 26 interfacing the valve body 10 and the spring retainer 24.

Adjustment is provided to the spring 16 by means of an adjusting screw and spring retainer 28 of the prior art. The adjusting screw and retainer 28 is seated within the spring retainer or cap 24 by means of being threaded into threads 30 therein. An exposed notch can receive a screwdriver or other adjustment tool to allow it to turn within the threads 30 and provide for increased or decreased pressure on the spring 16.

In order to transmit pressure from the diaphragm 12 to the valve, a pin support 38 made of brass or other suitable material is seated against the diaphragm 12. The pin support has an upstanding portion 40. The upstanding portion has an opening 42 therein which receives a pin 44. The pin 44 travels upwardly and downwardly within a passage or cavity 46 which is in the regulated intermediate pressure zone. The travel upwardly and downwardly in passage 46 allows for engagement of the pin against a high pressure seat 50. The high pressure seat 50 is formed of an elastomeric material and a seat body as will be detailed hereinafter.

The high pressure seat 50 has a passage 52 passing therethrough at the interface of the pin 44 and the seat. The passage 52 allows for the flow of gas into a space 54.

The space 54 is formed within a spring block 56. The spring block 56 receives a spring 60 surrounding the spring block. The spring block 56 is formed with a shoulder 62 which receives the spring 60 at one end while the other end of the spring engages the high pressure seat 50. This allows the high pressure seat 50 to move upwardly and downwardly against the spring 60 so that pressure can be regulated.

The spring block 56 with the opening or cavity 54 therein is sealed by means of an O-ring 66. The O-ring 66 is formed in surrounding relationship to an upstanding portion of the high pressure seat valve body, namely upstanding portion 70. In this manner, it seals the area around the upstanding portion 70 such that flow from the high pressure side in area or cavity 74 surrounding the spring block 56 cannot flow into the space or cavity 54. The space or cavity 54 is fundamentally at the intermediate pressure. To provide for movement of the upstanding portion 70 against the O-ring 66, a light lubricant can be utilized.

In order to hold the spring block 56 in position it is provided with a circular recess 76. The circular recess 76 receives a spring 78 which is used to hold the spring block 56 in place. At the other end, the spring 78 is seated against a filter 80. The filter can be made of a sintered metal. The filter 80 is held in place by means of a C clip 82. The C clip 82 can be substituted by any means for expanding into a notch 84 to hold the filter 80 in place by the spring 78 which expands against it while it is pushing against the spring block 56. The spring block is checked from movement by engaging a shoulder 83 of the valve body 10.

In order to receive a flow of gas, the regulator is secured to a high pressure tank by means of a yoke which is well known in the art. The yoke has a yoke screw connected to a threaded shaft. The yoke screw is formed with a knob secured to a rotatable shaft threaded by threads into the yoke. This allows for an end 100 to be threaded against a tank valve outlet for driving it against a surface 102 to provide for the flow of high pressure gas in the direction of arrow 104 into the regulator opening 105 in communication with chamber 74.

The flow of high pressure gas in the direction of arrow 104 flows into the high pressure side of the regulator. This can be defined in the area surrounding the spring block 56 such as passage cavity or space 74, space 75 and interfacing area 77 surrounding the spring block. A further high pressure passage 79 is seen passing to a high pressure port 81. The port 81 allows for access to the high pressure so that a determination can be made by means of a gauge as to the high pressure remaining in a tank of gas, such as a tank used for self-contained underwater breathing apparatus.

The low, lower, or intermediate pressure (used interchangeably) that has been regulated is seen within the passage opening 46 which leads from cavity 47 having an outlet 49 which is connected to the second stage or demand regulator. Lower or intermediate pressure is also seen within the space 54 in the spring block above the high pressure seat 50 upright portion 70. Additionally, intermediate pressure is seen in the area surrounding the diaphragm 12 at the pin support 38. This can be seen with respect to space 120.

The intermediate or lower regulated pressure can be sensed or utilized from the cavity 47 at threaded port 59. In this manner, intermediate pressure can be used to fill a buoyancy compensator or provide for other uses such as another demand regulator connected thereto for an emergency.

In operation, when a decreased pressure is sensed at opening 49 by a user inhaling, thereby creating demand for breathing gas, the first stage regulator then functions. It functions by virtue of intermediate pressure decreasing in the intermediate pressure zone such as within cavity 120 so that the diaphragm 12 then flexes inwardly. This attendantly allows the pin support 38 to move the pin 44.

As the pin 44 is moved, it moves downwardly at its interface 179 with the interior body of the high pressure valve seat 50. As it moves downwardly against the interior of the valve seat body it causes the valve seat of the high pressure seat 50 to move downwardly. Upon moving downwardly against the pressure of spring 60, it exposes an orifice 200. The orifice 200 is in connected relationship to the intermediate pressure area 46 and allows the flow of gas over the edges 202 or crown surrounding the orifice 200.

The assignee of this invention has consistently referred to the orifice 200 and crown 202 as such; with the moving member being the seat. This is not necessarily consistent with the industry which sometimes refers to the orifice 200 and crown 202 as the seat. However, the nomenclature hereof will refer to the moving member as being the seat 50.

The high pressure seat 50 incorporates a brass seat body having a stem or upstanding portion 70 with a shoulder 179 against which the pin 44 is seated.

The high pressure seat has an enlarged flat. Within the flat end, a groove or circular space 214 is provided. The space 214 receives a compression molded rubber elastomeric material 215. The compression molded rubber is adhered to the metal of the high pressure seat 50 by means of an adhesive.

Figure 5:
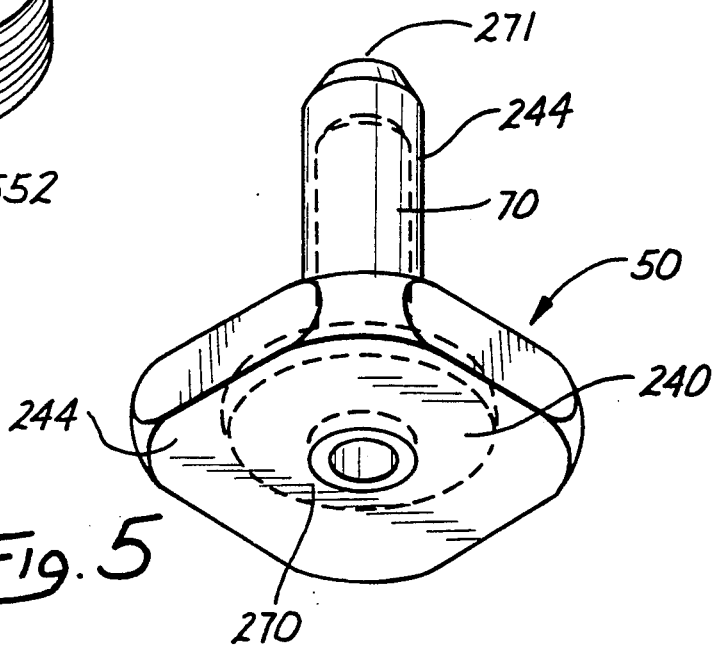
FIG. 5 shows a perspective view of an alternative valve seat of this invention.

The inventor hereof has invented a unique seal which prevents any transition between the sealing media 215 and the underlying body of the high pressure seat 50. Looking at FIG. 5, it can be seen that the high pressure seat body 50 is shown with the upright or stem portion 70 and a flattened end portion 240. These form the metal seat body upon which plastic is molded upon. The flattened interior seat body portion or flat 240 receives a molded material around it, and the upright portion 70. The molded material can be in the form of a product known generally as a thermoplastic resin in the form of polyether block amides. It is comprised of regular and linear chains of rigid polyamide (Nylon) and flexible polyether blocks.

The chemical formulation allows for a sufficiently resilient material that is not overly soft yet at the same time provides a seal against the crown 202. It has been found that material in the form of the plastic resin, namely plastic resin 244, which is formed around the flattened portion 240 of the high pressure seat body, as well as the stem 70, should be relatively hard but not so hard as to prevent a resilient seal against the crown 202. This is because of the fact that the plastic resin 244 surrounding the upright stem 70 of the high pressure seat 50 must pass through the O-ring 66. If it is not sufficiently hard, it will bind and adhere against the O-ring 66 thereby causing it to wear and in extreme cases be extruded into the space 54. In order to prevent the high pressure of cavity 74 from extruding the O-ring 66 into the space 54, a TEFLON TM (tetrafluoroethylenefluorocarbon resins and fluorinated ethylene-propylene resins) O-ring known as a parback 250 is utilized.

The flattened end 240 with the plastic 244 surrounding it does not provide a transition or junction exposed to the high pressure of the cavity 74. The plastic or polymer extends over the crown 202 and into the space 200 so that the only junction points or termination points are seen at interface 270 between the flattened end of the high pressure body and the polymer 244, and at the end of the stem at point 271 within cavity 54. At these partlines or junction points 270 and 271, intermediate pressure has been provided. The pressure is not of such a magnitude as to drive the plastic 244 away from the flattened end 240 so as to cause delamination. Also, where the stem 70 interfaces with the plastic at point 271, low or intermediate pressure is seen due to the pressure in cavity 54.

Various types of polymers and plastics can be utilized in order to surround the seat body metal of the high pressure seat 50. However, it has been found that the foregoing polymer within a shore D range of between 58 and 68 will generally satisfy the usage by virtue of the fact that it will not bind against the O ring 66 yet at the same time provide a seal against the crown 202. Other ranges can be used as well as shore ranges from 45 to 85. In such cases modification of the O-ring 66 must be undertaken and redesigned and characteristics of the crown 202 must be considered.

Looking more particularly at FIG. 1 with the prior art that has been bifurcated by a center line, it can be seen that the cap or support 24 of the prior art overlies a diaphragm 500. Diaphragm 500 extends across the entire regulator of the prior art and serves to allow ambient pressure to act on a fluid such as silicone oil 502 that is sealed by the diaphragm. In order to hold the diaphragm in place, a diaphragm retainer 504 is shown. The diaphragm retainer 504 has a step or insert 506 which receives an upstanding circular flange 508 of the diaphragm.

The diaphragm 500 has a convoluted configuration in the form of a wavy cross section with a circular wave like ridge 510 circumscribing the diaphragm to create flexibility.

In order to secure and adjust the spring 16, a spring retainer and adjustment screw 514 is shown. The spring adjusting screw 514 is threaded by means of threads 516 into the cap 24. In the prior art, the diaphragm 500 had to be removed by unthreading the diaphragm retainer 504 and then threadably moving the spring adjustment screw 514 to create greater or lesser compression on the spring 16. This was done by removing the diaphragm 500 as well as exposing a slot 520 of the spring adjustment and retaining screw 514 so that it could be screwed upwardly and downwardly. Consequently, the compression on the spring 16 was adjusted by putting a screw member into the slot 520 of the screw adjustment 514 and turning it after removal of the diaphragm 500.

Looking at the entire configuration it can be seen that the silicone oil 502 which couples ambient pressure would be displaced by removal of the diaphragm 500 after unthreading of the diaphragm retainer 504. This is a cumbersome and difficult task to perform on a continuum. Consequently, it is usually advisable to adjust the regulator in an environment which is not in the field.

Looking more particularly at the remaining FIGS. 2, 3, 4, and 5, the invention can be seen. The invention incorporates an adjustment means in the form of a screw head and stem.

A diaphragm in the form of diaphragm 530 is shown having an upstanding portion 532 for receipt by the diaphragm retainer 504 which is identical to the diaphragm retainer of the prior art. This diaphragm retainer 504 serves the function of securing the diaphragm within the cap 24.

The diaphragm 530 is provided with an undulated circumferential series of lands and grooves such as land 536 and groove or channel 538. This allows for expansion and contraction to permit a flexible reaction of the diaphragm 530.

Figure 3:
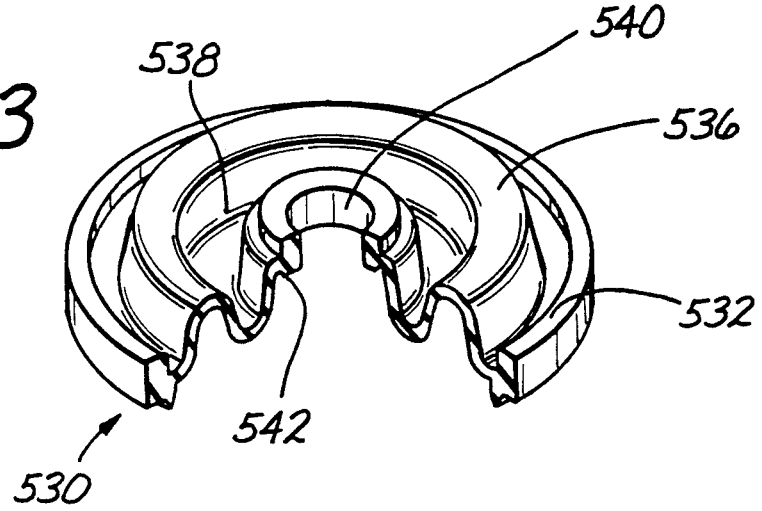
FIG. 3 shows a perspective view of the diaphragm of this invention with a quadrant removed.
Figure 4:
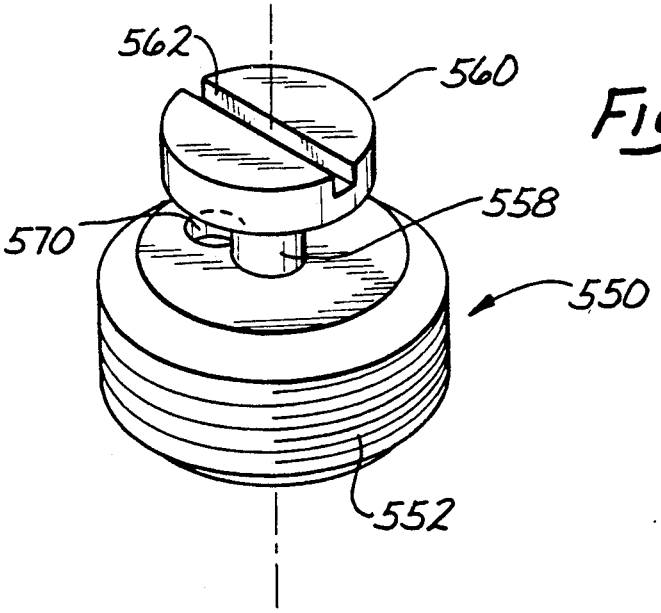
FIG. 4 shows a perspective view of the adjustment screw means of this invention.

As can be seen in the perspective view of FIG. 3 the diaphragm has an opening 540 passing therethrough with an expanded or enlarged portion 542 which provides for a tightened elastomeric gripping of a member such as the stem passing therethrough.

The adjustment means is in the form of a threaded spring adjustment screw formed with an inverted cap like screw 550. The threaded screw adjustment 550 has threads 552 and the sides of its cap like screw are threaded into the sidewalls of the cap 24. These threads 552 allow for adjustment upwardly and downwardly within interior threads of the cap 24.

A stem 558 is shown attached to the screw portion 552. The stem 558 terminates at a slotted screw portion or head 560 having a screw slot 562 therein. The head 560 can be formed as a screw head, bolt head, allen head, wing nut head, or any other type of head to apply torque to the stem 558, and screw 550.

In order to allow for balance of the silicone oil 502 in the regulator, an opening 570 is provided. This opening 570 allows for the passage of the silicone oil to the area just beneath the diaphragm 530 and into the main spring portion therein where the remainder of the oil 502 is. The oil serves to couple ambient pressure to the main or operating diaphragm 12.

The oil 502 can have a viscosity in the range of 300 to 500 centipoise. This range effectively provides a proper coupling response and helps to prevent leaks between the stem 558 and the diaphragm 530. When the oil is outside of these centipoise ranges it promotes leaking when less than 300 and slow response when over 500 centipoise.

The radial elasticity of the opening 540 permits a gripping on the stem 558 to allow for threaded movement of the adjustment screw 550 while at the same time retaining the oil 502 therein. There is no requirement for removing the diaphragm 530 and the diaphragm retainer 504 and then adjusting the screw adjustment as in the prior art which contributes to a possible spilling of the oil and a disruption of function as well as introduction of impurities. This invention specifically allows for external adjustment of the regulator by means of merely turning a screwdriver or other turning instrument in the slot 562 or head 560 to allow for movement along the threads of the cap 24 which attendantly adjusts the spring 16 as to compression.

As a consequence, the invention is a significant step over the prior art. It provides for more effective diving than is known to date. It is believed that this invention should be given broad claims coverage as set forth hereinafter to the full scope and extent of the claims.

I claim:

1. A first stage breathing gas regulator for use with self-contained breathing apparatus comprising:

a valve body;

means for introducing high pressure gas into said valve body;

an intermediate pressure chamber;

an orifice within said valve body connecting said means for introducing high pressure gas and said intermediate pressure chamber;

movable seat means coacting with said orifice for valving said high pressure gas to a lower intermediate pressure within said intermediate pressure chamber;

first spring means for operatively biassing said movable seat means sealingly against said orifice;

a main operative diaphragm mounted within said valve body and having a first side and a second side, said first side being exposed to said intermediate pressure chamber and said second side being exposed to the ambient;

linkage means between said main diaphragm and said movable seat means for moving said movable seat means against the bias of said first spring means in response to movement of said main operative diaphragm;

a cavity overlying said main operative diaphragm, said cavity having a threaded cylindrical upper portion, said cavity portion for receiving a predetermined quantity of coupling fluid;

a second diaphragm overlying said cavity to retain coupling fluid within the cavity;

an opening within said second diaphragm;

screw means having a threaded end and an extended end, said threaded end matingly engaging the threaded cylindrical upper portion of said cavity, and said extended end extending through said opening in said second diaphragm, said screw means for moving along the threaded cylindrical upper portion of said cavity; and, a second spring means having a first end and a second end, said first end engaging said screw means proximate said threaded end and said second end abutting said main diaphragm, said second spring means biassing said main diaphragm toward said intermediate pressure chamber; wherein said screw means is accessible for rotation to adjust said second spring means without disassembly of the regulator.

2. The regulator as claimed in claim 1 further comprising:

a head means attached to said extended end which can be turned to turn said threaded member.

3. The regulator as claimed in claim 2 further comprising:

a cap forming said threaded end of said screw means and threaded into said threaded cylindrical upper portion of said cavity of said regulator and having said extended end passing therefrom through said second diaphragm; and head means connected to said stem through said second diaphragm that can be turned to apply torque to the cap for movement along said threaded cylindrical upper portion of said cavity of said regulator body.

4. The regulator as claimed in claim 3 wherein:

said second diaphragm is flexible having undulations in its cross-sectional sidewall to allow for flexibility thereof.

5. The regulator as claimed in claim 4 further comprising:

a passage through said cap to transfer ambient pressure by said coupling fluid to said main operative diaphragm.

6. The regular as claimed in claim 5 wherein:

said linkage means is formed as a pin extending from said movable seat means to an enlarged mushroom shaped member that is imposed against said main operable diaphragm from said intermediate pressure chamber.

7. The regulator as claimed in claim 1, said movable seat means further comprising:

a valve seat formed as a metal member having an enlarged surface for covering said orifice; and a plastic coating surrounding said metal member from interiorly of said orifice to the exterior thereof around said metal member to the point where it extends into said intermediate pressure chamber.

8. A combination of a regulator having a spring block with a first spring which operatively biases a movable valve seat formed with a surface for sealing against an orifice for valving high pressure gas to a lower intermediate pressure and a pin type linkage for driving said movable valve seat away from said orifice when said pin type linkage is moved in response to a main operative diaphragm which is actuated by an imbalance between ambient pressure on one side thereof and intermediate pressure on the other side and wherein said main operative diaphragm is overlain by a cavity having a second diaphragm overlying said cavity for retention of a coupling fluid within said cavity and a coil spring within said cavity which is biased against said main operative diaphragm and said second diaphragm wherein the improvement comprises:

threaded adjustment means having a threaded end against which said coil spring is seated which is threaded into the sidewalls of said cavity; and means extending from the threaded adjustment means through said second diaphragm having an exterior portion thereof which can be used to rotate said adjustment means to adjust the compression of said coil spring without disassembly of the regulator.

9. The improvement as claimed in claim 8 wherein:

said threaded adjustment means for said coil spring is formed as a cap member for holding said spring.

10. The improvement as claimed in claim 9 further comprising:

a stem extending from said cap member through said second diaphragm having a portion suitable for turning by means of a tool.

11. The improvement as claimed in claim 10 wherein:

said tool turning portion has a screw slot.

12. The improvement as claimed in claim 11 further comprising:

said second diaphragm is formed with an undulated cross-section and a passage therethrough which has been cross sectionally enlarged from the general cross-section for retaining coupling fluid by seating the enlarged cross-section against said stem passing through said passage of said diaphragm.

13. The improvement as claimed in claim 12 further comprising:

a valve seat formed as a T with a portion thereof within said spring block and having a plastic surface on the transverse portion of the T for engaging the area around said orifice which extends from within said orifice around said inverted T to an end portion thereof seated within the spring block.

14. The adjustable regulator of the type having a main diaphragm exposed to intermediate pressure on one side and ambient pressure on the other with linkage means between said main diaphragm and a valve seat to cause said valve seat to move against the bias of a first coil spring which operatively biases said valve seat against an orifice for valving high pressure gas to a lower intermediate pressure when an imbalance occurs across said main diaphragm and a second coil spring abutting said main diaphragm which biases said main diaphragm toward said intermediate pressure side, the improvement comprising:

a cavity overlying said main diaphragm into which said second coil spring is emplaced, said cavity having a threaded cylindrical upper portion;

a coupling fluid within said cavity;

a covering diaphragm over said cavity to retain said coupling fluid within said cavity;

a spring retainer matingly engaging said threaded cylindrical upper portion into said cavity; and extension means from said spring retainer extending through a passage through said covering diaphragm for turning said spring retainer to adjust said second coil spring without disassembly of the regulator.

15. The improvement as claimed in claim 14 further comprising:

a cap like member forming said spring retainer into which said coil spring is seated.

16. The improvement as claimed in claim 15 further comprising:

extension means extending from said cap like member in the form of a stem passing through a passage through said covering diaphragm; and means external from said covering cavity in connected relationship to said stem for turning said stem and attendantly causing said spring retainer cap to move along the threads of the cylindrical upper portion of said cavity.

17. The improvement as claimed in claim 16 wherein:

said means for turning said stem comprise a screw head with a screw slot.

18. The improvement as claimed in claim 17 wherein: said means for turning said stem comprise a head for turning by a wrench.

19. The improvement as claimed in claim 16 wherein: said covering diaphragm is formed with undulations and an enlarged cross-section where said stem passes through the passage through said diaphragm to help retain coupling fluid within said cavity.

20. The improvement as claimed in claim 14 further comprising:

a valve seat operatively connected to the intermediate pressure side of said main diaphragm by a linkage, and overlying an orifice to be valved by said valve seat and held by spring means surrounding a block into which said valve seat passes in part; and wherein said valve seat is covered by a plastic for sealing said orifice, said plastic extending from within said orifice around said valve seat to a portion extending into the block into which said valve seat is retained.

* * * * *